US009167860B2

(12) United States Patent
Fedewa et al.

(10) Patent No.: US 9,167,860 B2
(45) Date of Patent: Oct. 27, 2015

(54) PROTECTIVE MODULAR HELMET WITH INTEGRATED LIGHTING SYSTEM

(71) Applicants: Craig M. Fedewa, Portland, MI (US); Mark A. Lambie, Eagle, MI (US)

(72) Inventors: Craig M. Fedewa, Portland, MI (US); Mark A. Lambie, Eagle, MI (US)

( * ) Notice: Subject to any disclaimer, the term of this patent is extended or adjusted under 35 U.S.C. 154(b) by 179 days.

(21) Appl. No.: 13/737,070

(22) Filed: Jan. 9, 2013

(65) Prior Publication Data

US 2013/0182414 A1 Jul. 18, 2013

Related U.S. Application Data

(60) Provisional application No. 61/586,267, filed on Jan. 13, 2012.

(51) Int. Cl.

| | |
|---|---|
| ***A42B 3/22*** | (2006.01) |
| ***A42B 3/04*** | (2006.01) |
| *A42B 3/00* | (2006.01) |

(52) U.S. Cl.

CPC ..... *A42B 3/0446* (2013.01); *A42B 3/221* (2013.01)

(58) Field of Classification Search

CPC ... F21V 21/084; F21V 33/00; F21V 33/0004; F21V 33/0008; A42B 1/004; A42B 1/244; A42B 3/0433; A42B 3/044; A42B 3/0446; A42B 3/0453

USPC ..... 362/105, 106; 2/6.5

See application file for complete search history.

(56) References Cited

U.S. PATENT DOCUMENTS

| | | | | |
|---|---|---|---|---|
| 5,207,500 | A | 5/1993 | Rios et al. | |
| 5,408,393 | A | 4/1995 | Becker | |
| 6,659,618 | B2 | 12/2003 | Waters | |
| 7,303,302 | B2 | 12/2007 | Harris | |
| 7,530,704 | B2 | 5/2009 | Harris | |
| 7,841,026 | B2 | 11/2010 | Makris et al. | |
| 2007/0019399 | A1 | 1/2007 | Harris | |
| 2007/0250991 | A1 * | 11/2007 | Pierce | A42B 3/281 2/414 |
| 2008/0068825 | A1 | 3/2008 | Harris | |
| 2009/0229040 | A1 | 9/2009 | McLean et al. | |
| 2009/0257217 | A1 | 10/2009 | Harris | |

FOREIGN PATENT DOCUMENTS

| | | | | |
|---|---|---|---|---|
| DE | 20318949 | | 4/2004 | |
| DE | WO 2011015300 | A1 * | 2/2011 | A42B 3/042 |
| WO | 2011/015300 | | 2/2011 | |
| WO | WO 2011015300 | A1 * | 2/2011 | |

* cited by examiner

*Primary Examiner* — Anh Mai
*Assistant Examiner* — Nathaniel Lee
(74) *Attorney, Agent, or Firm* — Dickinson Wright PLLC

(57) ABSTRACT

The disclosure relates to a protective modular helmet with an integrated lighting system, for example for use by a rider/driver of a vehicle such as a snowmobile, a motorcycle, or an all-terrain vehicle. A light source is mounted at chin level in the helmet. A moveable chin bar covers or conceals the light source when lowered. When the chin bar is raised, the light source is exposed and can be used for illumination.

20 Claims, 6 Drawing Sheets

PROTECTIVE MODULAR HELMET WITH INTEGRATED LIGHTING SYSTEM

CROSS REFERENCE TO RELATED APPLICATION

Priority is claimed to U.S. Provisional Application No. 61/586,267 (filed on Jan. 13, 2012), which is incorporated herein by reference in its entirety.

BACKGROUND OF THE DISCLOSURE

1. Field of the Disclosure

The disclosure relates to a protective modular helmet with an integrated lighting system, for example for use by a rider/driver of a vehicle such as a snowmobile, a motorcycle, or an all-terrain vehicle (ATV). A light source is mounted at chin level in the helmet. A moveable chin bar covers or conceals the light source when lowered (e.g., while riding/driving the vehicle). When the chin bar is raised, the light source is exposed and can be used for illumination (e.g., while the vehicle is at rest).

2. Brief Description of Related Technology

International Publication No. WO 2011/015300 is directed to a protective helmet incorporating a camera unit.

Harris U.S. Pat. No. 7,530,704 relates to an electrical power system for a crash helmet, including a storage cell configured to provide electrical energy to a power system, the storage cell being coupled to a processor and sealed within a lining of a helmet, and a pocket formed within the lining of the helmet, the pocket being configured to house the system.

German Publication No. DE 20318949 is directed to an LED lamp incorporated in a motorcycle helmet for ambient environment illumination.

U.S. Pat. Nos. 5,207,500, 5,408,393, 6,659,618, and Publication 2009/0229040 are generally directed to helmets, hats, or other headgear incorporating a light.

SUMMARY

In one aspect, the disclosure relates to helmet comprising: (a) a head protection portion defining a forward direction and comprising an upper cranial portion, an intermediate eye-level portion, and a lower chin-level portion; (b) a light source mounted to the lower chin-level portion of the head protection portion, the light source defining an illumination axis in the forward direction; and (c) a visor adjustably mounted (e.g., rotatably mounted) to the head protection portion, the visor comprising an upper face-guard portion and a lower chin-guard portion; wherein: (i) the visor is adjustable between a closed configuration and an open configuration on the head protection portion; (ii) in the closed configuration, the upper face-guard portion of the visor permits viewing of the external environment by a wearer of the helmet, and the lower chin-guard portion of the visor covers the light source; and (iii) in the open configuration, the light source is exposed to the external environment. In an embodiment, (i) the head protection portion comprises (A) a shell having an outer surface and an inner surface, and (B) an interior fitting mounted to the inner surface of the shell, (ii) the visor is adjustably mounted to the outer surface of the head protection portion; and (iii) the light source is mounted to the lower chin-level portion of the interior fitting. In a further refinement, (i) the interior fitting comprises a cheek portion removably mounted to the inner surface of the shell; (ii) the light source is mounted to the lower chin-level portion of the cheek portion of the interior fitting; and (iii) the helmet further comprises a power source in electrical connection with the light source and mounted to the lower chin-level portion of the cheek portion of the interior fitting.

In another aspect, the disclosure relates to a lighting system comprising: (a) a cheek pad comprising a lower chin portion; (b) a light source mounted to the lower chin portion of the cheek pad, the light source defining an illumination axis; (c) a power source mounted to the cheek pad and in electrical connection with the light source; (d) an electrical switch mounted to the cheek pad and in electrical connection with the light source and the power source, the electrical switch being positioned to control electrical power delivery from the power source to the light source; and optionally (e) a fastening means for removably mounting the cheek pad to the interior surface of the helmet; wherein the cheek pad is adapted for mounting on an interior surface of a helmet comprising a head protection portion defining a forward direction and an open face area such that the light source is positioned in a lower chin-level portion of the head protection portion with its illumination axis in the forward direction. In an embodiment, the cheek pad comprises an inner rigid layer, an intermediate cushion layer, and an outer soft layer.

In another aspect, the disclosure relates to a method for performing vehicle maintenance, the method comprising: (a) providing a vehicle in need of maintenance (e.g., a snowmobile, a motorcycle, an all-terrain vehicle); (b) providing a modular helmet with a light source according to any one of the various disclosed embodiments; (c) wearing the helmet in the open configuration, thereby exposing the light source of the helmet; (d) activating the light source, thereby emitting light therefrom; (e) illuminating an area of the vehicle in need of maintenance with the emitted light; and (f) performing the needed maintenance on the vehicle in the illuminated area. In an embodiment, the illuminated area is selected from the group consisting of an engine compartment, a fuel compartment, a storage compartment, a tire, a track/drive belt, and a ski.

In another aspect, the disclosure relates to a kit comprising: (a) at least one of the helmet and the lighting system according to any one of the various disclosed embodiments; and (b) instructions describing use of the light source of the helmet or the lighting system to assist a wearer with at least one of vehicle maintenance or navigation on foot (e.g., in darkness).

Various refinements and extensions of the foregoing apparatus, kits, and methods are possible. For example, the power source can comprise a battery. In an embodiment, the light source comprises a light-emitting diode (LED). In another embodiment, the light source provides a divergent, axisymmetric light emission pattern about the illumination axis. In another embodiment, the light source provides a relative luminous intensity of at least 70% at an emission angle of 30° relative to the illumination axis.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

Figure 1:
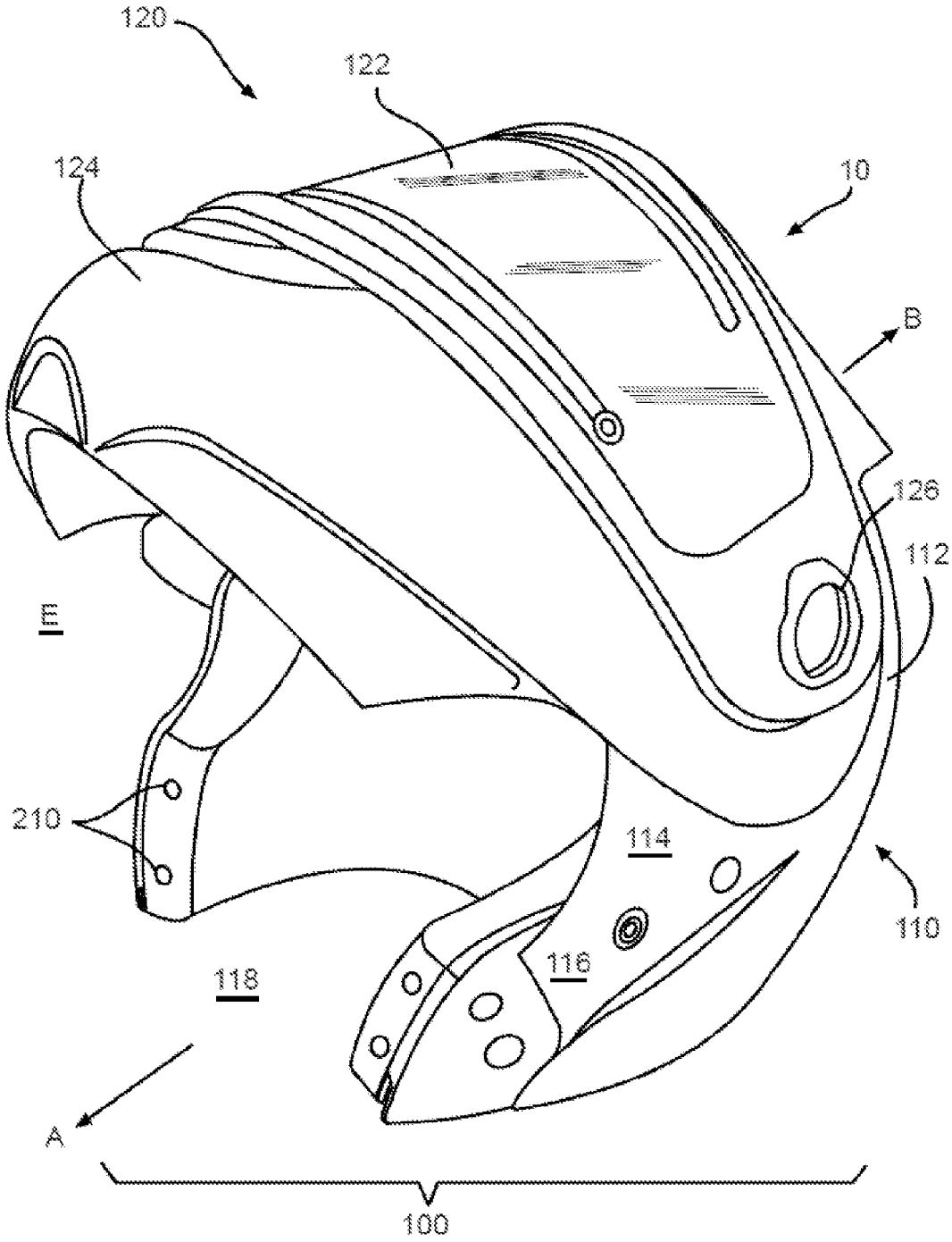
FIG. 1 illustrates a front perspective view of a helmet according to the disclosure in an open configuration with a raised visor/chin portion.

While the disclosed apparatus, methods, and kits are susceptible of embodiments in various forms, specific embodiments of the disclosure are illustrated in the drawings (and will hereafter be described) with the understanding that the disclosure is intended to be illustrative, and is not intended to limit the claims to the specific embodiments described and illustrated herein.

DETAILED DESCRIPTION

With general reference to FIGS. 1-7, the disclosure relates to a protective modular helmet 10 that includes a light source 210 (e.g., one or more light sources 210 such as a plurality thereof). The light source 210 is generally mounted at chin-level in the modular helmet 10 such that during riding or other normal use of the helmet 10, the light source 210 is covered or concealed from external view when the helmet chin bar 124 is in its lowered position. When the chin bar 124 is raised, the light source 210 is exposed and can be powered on to provide illumination. The light source 210 is not intended to provide visibility when driving. Instead, the light source 210 is intended to provide illumination for a stopped rider in the darkness who is resting, performing vehicle maintenance, making his way on foot, etc.

An advantage of the chin-level light source 210 mounting is that it avoids potential glare resulting from an expanding light source, which could otherwise substantially impair a user's vision for an eye-level mounted light. Another advantage is that the chin bar 124 protects the light source 210 and other lighting system elements from damage such as by debris while riding the vehicle. This contrasts with externally mounted lights intended for use while driving (e.g., which provides increased visibility of the rider by others or visibility by the rider) which are subjected to damage.

Modular Helmet

As shown in FIG. 1, the modular helmet 10 includes a head protection portion 100 and a lighting system 200. The head protection portion 100 of the helmet 10 includes a shell 110 and a visor 120. The helmet 10 can be of the type commonly used for safety when engaging outdoor activities, for example including a snowmobile helmet, a motorcycle helmet, an ATV helmet, a skiing/snowboard helmet, and a bicycle helmet (e.g., activities where the absence of ambient (outdoor) lighting can become an issue).

The shell 110 is typically formed from a hard, impact-resistant material as generally known in the art for use in a safety helmet for an exposed rider of a vehicle such as a snowmobile, a motorcycle, or an all-terrain vehicle. The shell 110 includes a top portion 112 (i.e., generally enclosing and protecting the head/cranial region of the wearer), a middle portion 114 (i.e., generally at eye- and ear-level of the wearer), and a lower portion 116 (i.e., generally at chin-, jaw-, and mouth-level of the wearer). The shell 110 alone provides an open-face helmet configuration such that the middle and lower portions 114, 116 together enclose the back of the wearer's head and define an open-face area 118 and a forward direction A for the helmet 10. The forward direction A generally corresponds to a horizontal, forward line-of-sight for a wearer of the helmet 10. The helmet 10/shell 110 similarly defines a backward direction B opposite that of the forward direction A.

The visor 120 includes a face-guard portion 122 and a lower chin-guard portion 124. Similar to the middle and lower portions 114, 116 of the shell 110, the face-guard and chin-guard portions 122, 124 are generally at eye- and chin-level, respectively, when the visor 120 is lowered. The face-guard 122 is at least partially formed from a transparent material to permit vision therethrough by the wearer. The chin-guard 124 can be formed from the same material as the shell 110, and it is suitably an opaque material that conceals the light source 210 when the visor 120 is lowered. In an embodiment, all light sources 210 or at least those mounted at chin level in the helmet 10 are concealed/covered when the visor 120 is lowered.

As illustrated, the visor 120 can be mounted to an outside surface of the shell 110, for example with a fastening means 126 such as a hinge or other rotatable fastener. The visor 120 is moveable/adjustable between an open configuration (i.e., as illustrated in FIG. 1) and a closed configuration (not shown) on the shell 110/head protection portion 100. In the closed configuration, the face-guard 122 of the visor 120 permits viewing of the external environment E by a wearer of the helmet 10, and the chin-guard 124 of the visor 120 covers the light source 210. In the open configuration, the light source 210 is exposed to the external environment E. As shown, the face-guard 122 and the chin-guard 124 can be raised as a unit to expose the open face area 118 of the helmet 10 without obstructing the eyesight of the wearer or the light/illumination path of the light source 210. In an embodiment, the face-guard 122 and the chin-guard 124 can be independently moveable/rotatable (e.g., where the face-guard 122 can be raised while the chin-guard 124 remains in a lowered/closed position).

Figure 2:
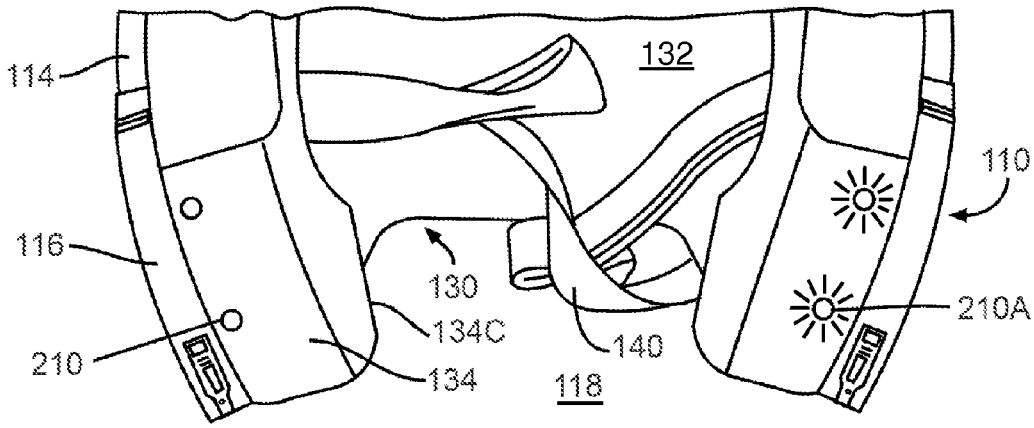
FIG. 2 illustrates a front view of a helmet with a raised chin bar and LED lights embedded in a cheek pad (lights on left are powered off, lights on right are powered on).

As shown in more detail in FIG. 2, the modular helmet 10/head protection portion 100 can further include an interior fitting 130 to provide additional head protection (e.g., shock/impact absorption and distribution) and comfort to the wearer. The interior fitting 130 is suitably mounted to the inner surface of the shell 110. The interior fitting 130 can have a modular design, for example including a top portion 132 (i.e., generally enclosing and protecting the head/cranial region of the wearer) and two opposing lower portions 134 (i.e., generally at chin-, jaw-, and mouth-level of the wearer, optionally extending up to about cheek-level of the wearer). As illustrated, the light source 210 can be mounted at chin level in the interior fitting 130, for example in one or both lower portions 134 of the fitting 130. A chin strap 140 is provided to secure the helmet 10 in place while being worn.

Lighting System

Figure 3:
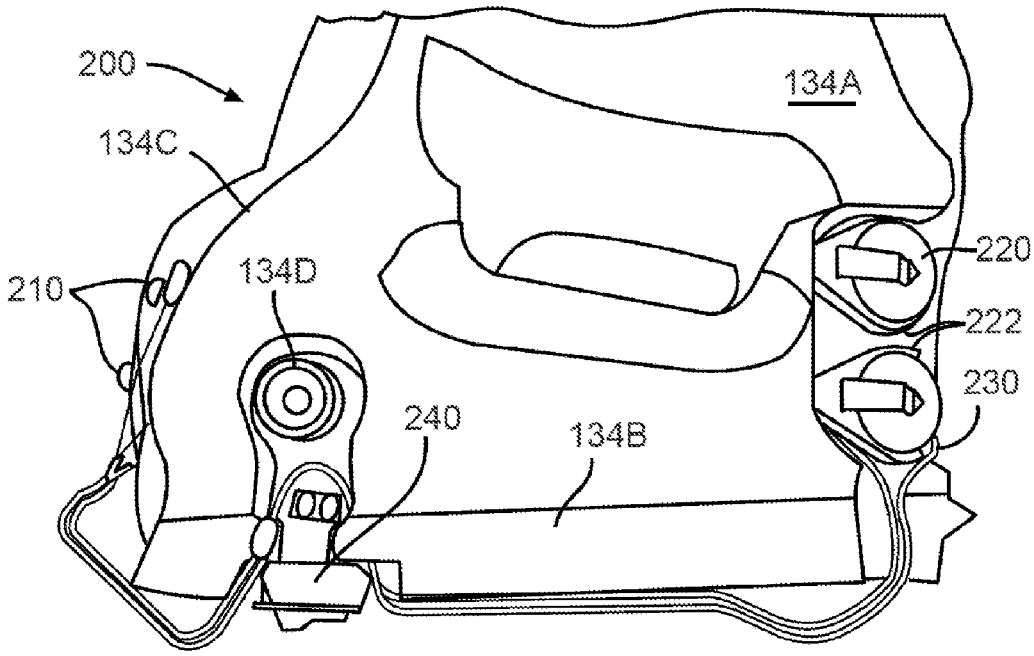
FIG. 3 illustrates a side view of a removed cheek pad showing an embedded LED system including (from left to right): LED lights, an electrical switch, batteries, and associated wiring.
Figure 4:
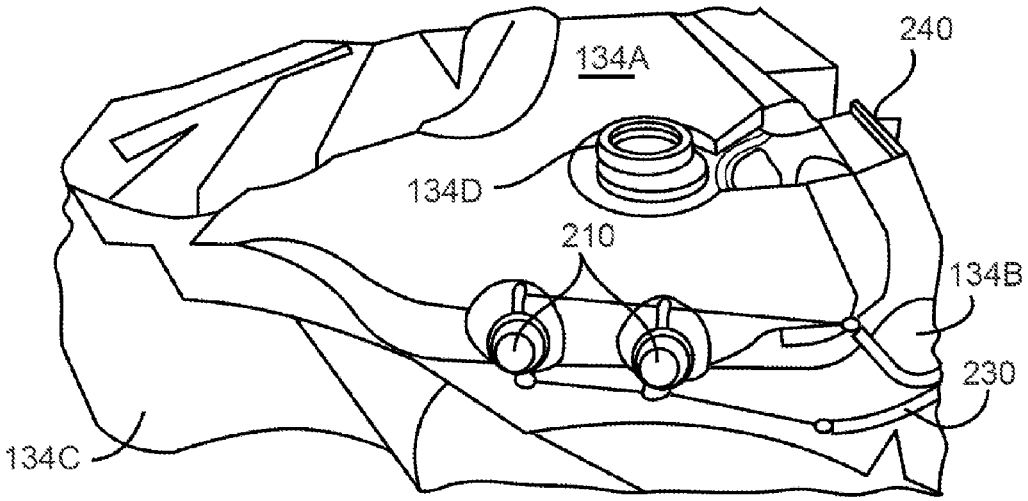
FIG. 4 illustrates a front perspective view of a removed cheek pad showing embedded LED lights and an electrical switch as part of a LED system.
Figure 5:
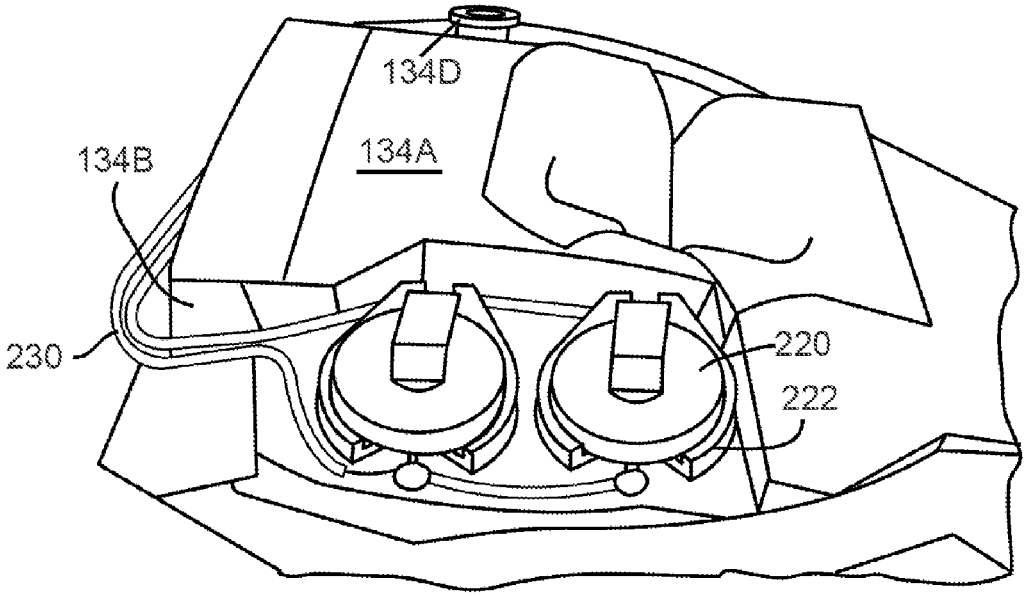
FIG. 5 illustrates a rear perspective view of a removed cheek pad showing embedded batteries as part of a LED system.

FIGS. 3-5 illustrate an embodiment of the interior fitting 130 and the lighting system 200 in more detail.

The lower portion 134 of the interior fitting 130 can be a cheek pad 134 that is removably mountable to the inner surface of the shell 110. The cheek pad 134 can have a multi-layer design, for example including an inner rigid layer 134A (e.g., a rigid foamed polymer), an intermediate cushion layer 134B (e.g., a flexible/spongy foamed polymer) adjacent or fixed to the rigid layer 134A, and an outer soft layer 134C (e.g., a cloth lining providing comfort to the wearer's head/face) adjacent or fixed to the cushion layer 134B. A fastening means 134D such as a snap can be included on the inner rigid layer 134A to facilitate attachment/detachment of the cheek pad 134/inner rigid layer 134A to the inner surface of the shell 110.

In the illustrated embodiment, each cheek pad 134 has two forward-facing light sources 210 to provide a symmetric, substantial source of illumination. In other embodiments (not shown), greater or fewer light sources 210 can be used (e.g., to provide more or less illumination as desired), and each cheek pad 134 can have a different number of light sources 210 relative to each other.

In addition to the light source(s) 210, the lighting system 200 can further include an electrical power source 220 and an electrical switch 240, all three of which are in electrical connection, for example via electrical wiring 230. The electrical switch 240 is positioned in the electrical circuit to control electrical power delivery from the power source 220 to the light source 210 (e.g., intermediate the light and power sources 210, 220). As shown, the light source 210, the power source 220, the wiring 230, and the electrical switch 240 are mounted to the cheek pad 134 (e.g., in or on the inner rigid layer 134A thereof) to provide a self-contained, modular cheek pad lighting system 200 unit that is adapted for mounting on an interior surface of a helmet such as the modular helmet 10 disclosed herein. Thus, in an embodiment, all of the electrical components for the helmet 10 generally and lighting system 200 particularly are contained in the cheek pad 134 (e.g., with other helmet structure generally being free from electrical components). The light source 210 is mounted to the lower chin portion of the cheek pad 134 such that it is at chin level when incorporated into the helmet 10. The positioning of the power source 220, the wiring 230, and the electrical switch 240 in the cheek pad 134 is not particularly limited and can be selected for ease of manufacture and/or ease of access by the user (e.g., permitting easy switch 240 accessibility and/or battery 220 replacement).

Figure 6:
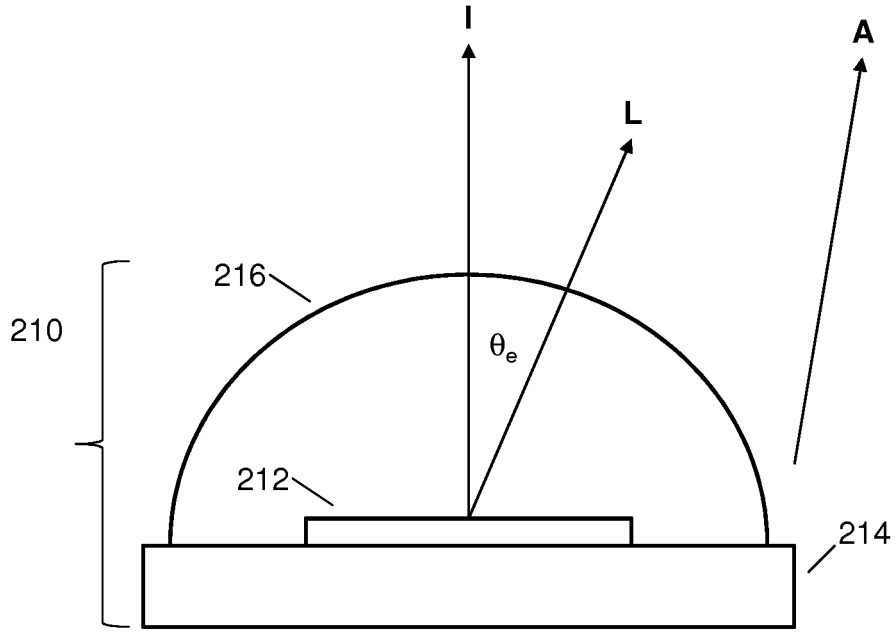
FIG. 6 illustrates a representative LED light for use in the disclosed embodiments.

The light source 210 can be any desired source, such as a light-emitting diode (LED), an incandescent light source, or a fluorescent source. LEDs are suitable because of their low power consumption, low cost, light weight, and relatively high illumination intensity. For example suitable LEDs can have a power consumption of at least 10 mW, 50 mW, 200 mW, or 1 W, and/or up to 50 mW, 200 mW, 1 W, 2 W, 5 W, or 10 W. Such LEDs alternatively or additionally can have a luminous flux of at least 1 lm, 2 lm, 5 lm, 10 lm, or 20 lm and/or up to 10 lm, 20 lm, 50 lm, 100 lm, or 200 lm. Similarly, the LEDs can have a viewing angle of at least 20°, 40°, 60°, 80°, or 100° and/or up to 40°, 60°, 80°, 100°, 120°, or 140° (e.g., where the brightness along the line of half the viewing-angle relative to a directly forward direction is half the brightness as that along the directly forward direction). A suitable commercially available LED light source 210 as illustrated has a power consumption of about 1 W with a viewing angle of 80° and a luminous flux of about 45 lumens. FIG. 6 illustrates a typical LED source 210 that includes a LED 212 mounted on a mounting surface 214 (e.g., a printed circuit board) and optionally enclosed with a transparent cover 216 (e.g., a clear transparent cover to permit white light transmission, a colored transparent cover to permit light transmission of selected wavelengths). As illustrated, the cover 216 has a generally hemispherical shape that protects the LED 212 but which does not substantially alter the optical path of emitted light L rays passing through the cover 216 to the external environment E. For example, aside from minor diffraction effects, the cover 216 does not tend to create a more focused light source. Thus, the light source 210/lighting system 200 suitably does not require or include other structure that tends to redirect the light rays from the light source 210 into a less disperse or more focused/collimated source, such as a focusing optical lens, a focusing (reflective) surface (e.g., a mirror), and/or a recess into which the light source 210 is mounted (e.g., a cylindrical recess).

The light source 210 defines an illumination axis I generally corresponding to the direction of highest emitted light intensity from the source 210 (e.g., generally perpendicular to the LED 212 and/or mounting surface 214 as illustrated). For reference, the forward direction A defined by the helmet 10 is shown in FIG. 6, illustrating that the illumination axis I can be in the forward direction A, but need not be parallel thereto once the light source 210 is incorporated into the helmet 10. For example, an angle between the illumination axis I and the forward direction A is suitably less than or equal to 45°, 30°, 15°, 10°, or 5°. In an embodiment, the illumination axis I can be selected to be angled up or down relative to the forward direction A (e.g., at least 5°, 10°, 15°, or 30°).

Figure 7:
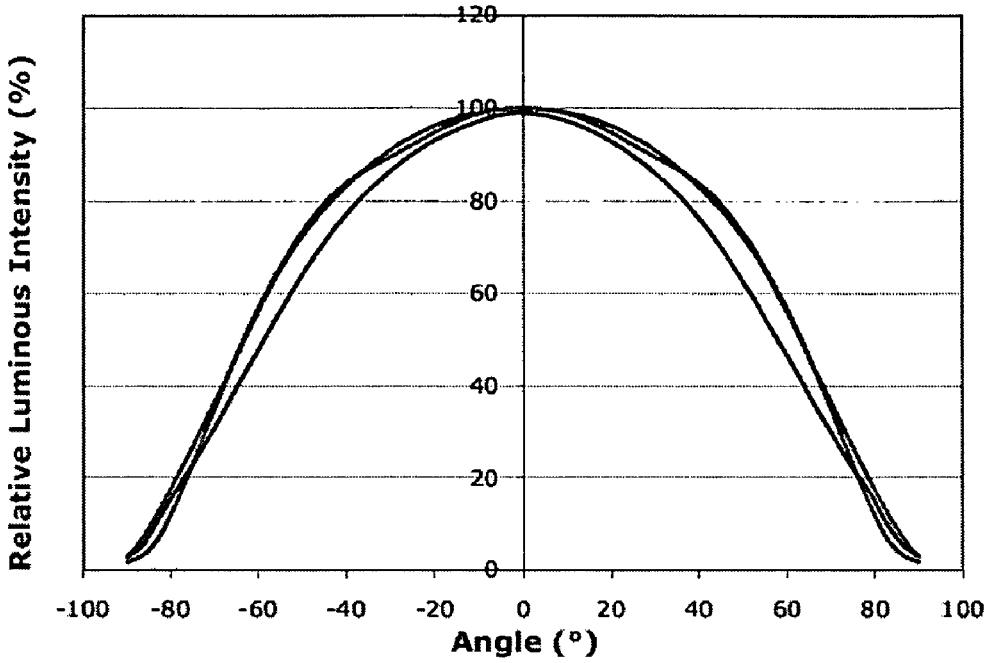
FIG. 7 is a graph illustrating representative light emission characteristics for an axisymmetric LED light in terms of relative luminous intensity as a function of the emission angle relative to the LED illumination axis.

The light source 210 suitably provides a disperse, divergent source of emitted light L. In an embodiment, the light L emitted from the light source 210 is generally symmetric around the illumination axis I (e.g., having a generally axisymmetric light intensity distribution around the illumination axis I in a plane perpendicular to the illumination axis I). The light source 210 suitably emits substantial light L at emission angles $\theta_e$ up to about +/−90° relative to the illumination axis I. For example, given a 100% relative luminous intensity along the illumination axis I (i.e., at an emission angle $\theta_e$ of 0°), the light source 210 can have a relative luminous intensity of at least 70% at an emission angle $\theta_e$ of 30° relative to the illumination axis I (e.g., at least 70%, 75%, 80%, or 85% and/or up to 80%, 90%, or 95%), a relative luminous intensity of at least 35% at an emission angle $\theta_e$ of 60° relative to the illumination axis I (e.g., at least 35%, 40%, or 45% and/or up to 45%, 55%, or 65%), and/or a relative luminous intensity of at least 10% at an emission angle $\theta_e$ of 80° relative to the illumination axis I (e.g., at least 5%, 10%, or 15% and/or up to 15%, 20%, or 25%). FIG. 7 is a graph illustrating representative light emission characteristics for an axisymmetric LED light in terms of relative luminous intensity as a function of the emission angle $\theta_e$ to the LED illumination axis I.

As noted above, an advantage of the disclosed lighting system 200 having a light source 210 mounted at a lower chin level is that the emitted light L does not create a vision-impairing glare in the wearer's eyes, which otherwise results from a expanding/diverging light source at an eye-level mount (e.g., horizontally displaced relative to the wearer's eyes). This is a significant advantage for light sources 210 such as LED sources that generally provide a disperse/divergent source of emitted light L. A disperse light source is desirable for use in the disclosed helmet 10, because it provides a relatively wide area of sufficient illumination at relatively close distances (e.g., generally corresponding to a 140°, 160°, or 180° forward-facing horizontal field of view typical of the human eye). For example, the light source 210 provides sufficient intensity up to about 5 ft, 10 ft, or 20 ft (including a wide field of view and ground visibility, such as illumination areas up to about 200 $ft^2$, 500 $ft^2$, or 1000 $ft^2$, in the field of view) for a rider disembarked from his vehicle and making his way on foot in a dark area without other substantial light sources (ambient or otherwise), such as at night and potentially in a wooded area or other obstructed area (e.g., which could block potential ambient moonlight and present dangerous obstructions such as trees, underbrush, etc. to a snowmobile or ATV rider on foot and away from his vehicle). Similarly, the light source 210 provides even greater intensity at up to about 1 ft, 2 ft, or 3 ft with a wide illumination area. This allows a dismounted rider to perform close work (e.g., vehicle maintenance or adjustment) in the dark with both hands free such that there is no need to hold a flashlight or have another rider provide lighting assistance. In contrast, an eye-level mount must use a more focused beam and/or a lower intensity light to avoid glare, resulting in a light that does not have a sufficient area of illumination and/or intensity of illumination to permit a disembarked rider to navigate on foot or perform vehicle maintenance.

The specific type of power source 220 is not particularly limited and can include one or more batteries or an electrical adapter to connect to another power source external to the helmet 10 (e.g., an external battery or other type of power source). As shown, the power source 220 suitably includes one or more batteries 220 mounted in battery housings 222 and electrically connected in parallel to the wiring 230; however, other suitable circuit configurations can be used as desired. A lithium-ion battery such as a coin cell battery (e.g., a standard lithium-manganese dioxide CR2032 battery rated at 3.0 volts) is suitable for integration into the cheek pad 134 given its low profile. Such batteries can provide up to about 24 hours of continuous use for a low-power light source 210 such as an LED light. The detachable nature of the cheek pad 134 permits easy removal for battery 220 access and replacement as needed.

The specific type of electrical switch 240 is not particularly limited and can include those generally known in the art. As shown, the electrical switch 240 can be a manual switch operated by the user to power on/off the light source 210. In an embodiment, the electrical switch 240 can be an automated switch to power on/off the light source 210 in response to various external stimuli or helmet states (e.g., a light sensor-activated switch that powers on the light source 210 in low ambient light conditions and vice versa; an automated switch that powers on the light source 210 when the visor 120 is opened and vice versa). In another embodiment, the lighting system can include multiple switches, for example a manual master switch 240 as illustrated in combination with a second automated switch (not shown), such as the light-activated switch or the helmet state-activated switch. In another embodiment, the electrical switch can be selected so that intermediate levels of emitted light intensity can be obtained (e.g., by providing a selectably attenuated level of power to the light source 210 and/or to power on a subset of a plurality of light sources 210).

Use of Modular Helmet

As described above, the helmet 10 with its lighting system 200 is useful to assist a rider disembarked from his vehicle to perform various tasks in the absence of other light sources such navigation on foot or close work on the vehicle. In various embodiments, the lighting system 200 is fully self-contained within the helmet 10, for example where there are no externally mounted lights and/or there are no external battery packs or wire hookups required. Such a configuration provides an increased aesthetic appearance of the helmet's outer surface and it further protects the system 200 components from damage when the light source 210 is not in use (e.g., while riding and the helmet 10 is subject to impact from environmental debris such as snow, ice, rain, dirt, mud, rocks, branches, underbrush, etc,). In embodiments using LED light sources 210, the long life cycle of the LEDs reduces or eliminates the need to replace the lights over the life cycle of the helmet 10 itself (e.g., because the helmet design prevents external damage to the light sources 210). Similarly, the small size and low energy demand of the LEDs requires correspondingly small battery power sources 220. As a result, the lighting system 200 is extremely light weight and it adds essentially no noticeable weight to the helmet 10 for the user.

In an embodiment, the helmet 10 and lighting system 200 can be used by a dismounted rider/wearer to perform maintenance on various types of vehicles including snowmobiles, motorcycles, and all-terrain vehicles. When wearing the helmet 10 with the visor 120 in the open configuration, the user's vision is completely unobstructed (e.g., without an intervening face-guard 122), and the exposed light source 210 provides sufficient wide-angle illumination to perform potentially detailed vehicle maintenance procedures at relatively close distances. As used herein, vehicle maintenance can generally include tasks such as replacing, repairing, or adjusting a vehicle component or a vehicle consumable (e.g., fuel, motor oil, or other vehicle liquid). For example, maintenance can be performed on various vehicle areas such as an engine compartment, a fuel compartment (e.g., to refuel the vehicle), a storage compartment, a tire, a track/drive belt (e.g., as a snowmobile component), and a ski (e.g., as a snowmobile component).

In an embodiment, the disclosure relates to a kit including the helmet 10 and/or the lighting system 200 along with instructions (e.g., printed or electronic) describing and/or illustrating use of the helmet 10/lighting system 200 to assist a user in navigation on foot and/or performance of vehicle maintenance.

EXAMPLES

FIGS. 1-5 described in detail above illustrate an embodiment of the disclosure in which the lighting system 200/light source 210 is integrated into a modular helmet 10.

FIGS. 8-12 illustrate other embodiments of the disclosure in which the lighting system 200/light source 210 is integrated into other helmet 10 configurations.

Figure 8:
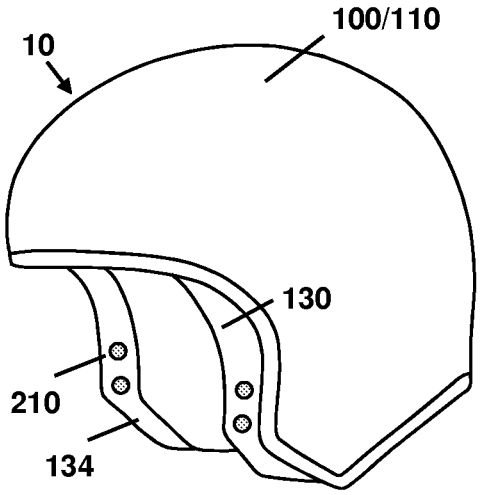
FIGS. 8-12 illustrate alternative embodiments of the disclosure with light sources and associated lighting systems integrated into open-face and full-face helmets.
Figure 12:
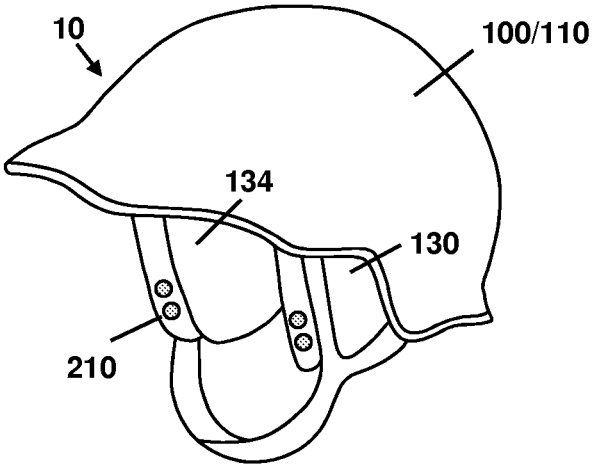

In FIGS. 8 and 12, the helmet 10 has an open-face configuration (e.g., analogous to the modular helmet 10 disclosed above including the head protection portion 110 but without the visor 120 and its faceguard/chin portions 122/124). The light sources 210 and other system 200 components are mounted into the lower cheek portion 134 of the interior fitting 130 as generally described above.

Figure 9:
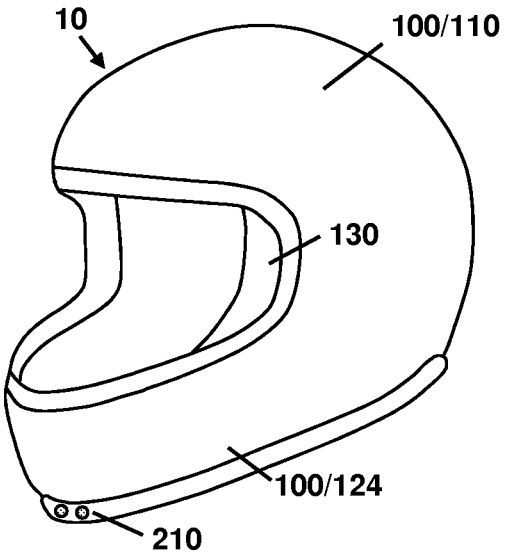
Figure 10:
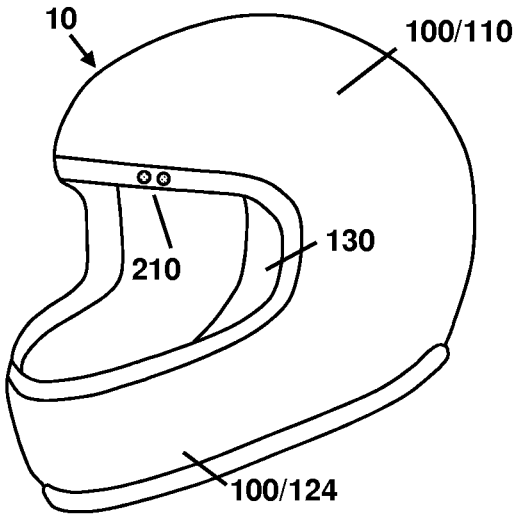
Figure 11:
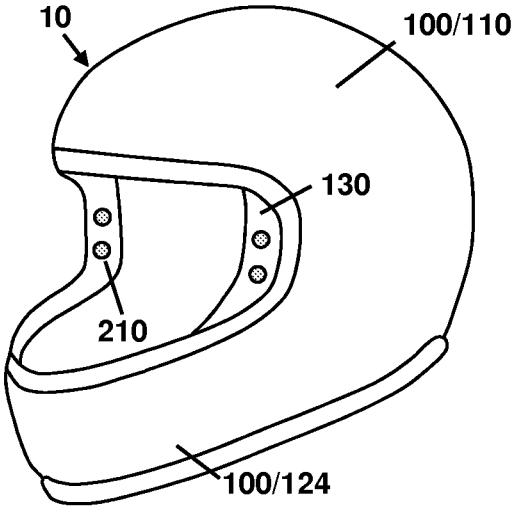

In FIGS. 9-11, the helmet 10 has a full-face configuration (e.g., analogous to the modular helmet 10 disclosed above but where the head protection portion 110 and the chin guard portion 124 are integrally formed into a single structural unit and/or are not moveable relative to each other). The light source 210 is mounted in the lower trim of the chin portion 124 (FIG. 9), in the upper trim of the head protection portion 110 (FIG. 10), or in the upper cheek area of the interior fitting 130 (FIG. 11). Other lighting system 200 components are mounted into the interior fitting 130 as generally described above.

Table 1 below provides a list of the various features illustrated in FIGS. 1-12.

TABLE 1

| Figure Elements | |
|---|---|
| Identifier | Element |
| 10 | helmet |
| A | forward direction |
| B | rearward direction |
| E | external environment |
| 100 | head protection portion |
| 110 | outer shell |
| 112 | top portion |
| 114 | middle portion |
| 116 | lower portion |
| 118 | open face area |
| 120 | visor |
| 122 | faceguard portion |
| 124 | chin portion |
| 126 | fastening means |
| 130 | interior fitting |
| 132 | top (head/cranial) portion |
| 134 | lower portion |
| 134A | rigid layer |
| 134B | cushion layer |
| 134C | soft layer |
| 134D | fastening means (snap) |
| 140 | chin strap |
| 200 | lighting system |
| 210 | light |
| 210A | illuminated light (powered ON) |
| I | illumination axis |
| L | emitted light |
| $\theta_e$ | emission angle |
| 212 | light-emitting diode (LED) |
| 214 | mounting surface |
| 216 | transparent cover |
| 220 | electrical power source |
| 222 | battery housing |
| 230 | electrical wiring |
| 240 | electrical switch |

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the apparatus or methods are described as including components, steps, or materials, it is contemplated that they can also comprise, consist essentially of, or consist of, any combination of the recited components or materials, unless described otherwise. Disclosed numerical values or ranges can represent precise or approximate (e.g., modified by the term "about") values, ranges, and sub-ranges thereof.

What is claimed is:

1. A helmet comprising: (a) a head protection portion defining a forward direction and comprising an upper cranial portion, an intermediate eye-level portion, and a lower chin-level portion; (b) a light source mounted to the lower chin-level portion of the head protection portion, the light source defining an illumination axis in the forward direction; and (c) a visor adjustably mounted to the head protection portion, the visor comprising an upper face-guard portion and a lower chin-guard portion; wherein: (i) the visor is adjustable between a closed configuration and an open configuration on the head protection portion; (ii) in the closed configuration, the upper face-guard portion of the visor permits viewing of the external environment by a wearer of the helmet, and the lower chin-guard portion of the visor covers the light source; and (iii) in the open configuration, the light source is exposed to the external environment.

2. The helmet of claim 1, wherein: (i) the head protection portion comprises (A) a shell having an outer surface and an inner surface, and (B) an interior fitting mounted to the inner surface of the shell, (ii) the visor is adjustably mounted to the outer surface of the head protection portion;and (iii) the light source is mounted to the lower chin-level portion of the interior fitting.

3. The helmet of claim 2, wherein: (i) the interior fitting comprises a cheek portion removably mounted to the inner surface of the shell; (ii) the light source is mounted to the lower chin-level portion of the cheek portion of the interior fitting; and (iii) the helmet further comprises a power source in electrical connection with the light source and mounted to the lower chin-level portion of the cheek portion of the interior fitting.

4. The helmet of claim 3, wherein the power source comprises a battery.

5. The helmet of claim 1, wherein the light source comprises a light-emitting diode (LED).

6. The helmet of claim 1, wherein the light source provides a divergent, axisymmetric light emission pattern about the illumination axis.

7. The helmet of claim 6, wherein the light source provides a relative luminous intensity of at least 70% at an emission angle of 30.degree. relative to the illumination axis.

8. The helmet of claim 1, wherein the visor is rotatably mounted to the head protection portion.

9. A method for performing vehicle maintenance, the method comprising: (a) providing a vehicle in need of maintenance; (b) providing the helmet according to claim 1; (c) wearing the helmet in the open configuration, thereby exposing the light source of the helmet; (d) activating the light source, thereby emitting light therefrom; (e) illuminating an area of the vehicle in need of maintenance with the emitted light; and (f) performing the needed maintenance on the vehicle in the illuminated area.

10. The method of claim 9, wherein the vehicle is selected from the group consisting of a snowmobile, a motorcycle, and an all-terrain vehicle.

11. The method of claim 9, wherein the illuminated area is selected from the group consisting of an engine compartment, a fuel compartment, a storage compartment, a tire, a track/drive belt, and a ski.

12. A kit comprising: (a) the helmet according to claim 1; and (b) instructions describing use of the light source of the helmet or the lighting system to assist a wearer with at least one of vehicle maintenance or navigation on foot.

13. A lighting system comprising: (a) a cheek pad comprising a lower chin portion; (b) a light source mounted to the lower chin portion of the cheek pad, the light source defining an illumination axis; (c) a power source mounted to the cheek pad and in electrical connection with the light source; and (d) an electrical switch mounted to the cheek pad and in electrical connection with the light source and the power source, the electrical switch being positioned to control electrical power delivery from the power source to the light source; wherein the cheek pad is adapted for mounting on an interior surface of a helmet comprising a head protection portion defining a forward direction and an open face area such that the light source is positioned in a lower chin-level portion of the head protection portion with its illumination axis in the forward direction.

14. The lighting system of claim 13, further comprising: (e) a fastening means for removably mounting the cheek pad to the interior surface of the helmet.

15. The lighting system of claim 13, wherein the cheek pad comprises an inner rigid layer, an intermediate cushion layer, and an outer soft layer.

16. The lighting system of claim 13, wherein the power source comprises a battery.

17. The lighting system of claim 13, wherein the light source comprises a light-emitting diode (LED).

18. The lighting system of claim 13, wherein the light source provides a divergent, axisymmetric light emission pattern about the illumination axis.

19. The lighting system of claim 18, wherein the light source provides a relative luminous intensity of at least 70% at an emission angle of 30.degree. relative to the illumination axis.

20. A kit comprising: (a) the lighting system according to claim 13; and (b) instructions describing use of the light source of the helmet or the lighting system to assist a wearer with at least one of vehicle maintenance or navigation on foot.

* * * * *